US009574255B2

(12) United States Patent
Higashida et al.

(10) Patent No.: US 9,574,255 B2
(45) Date of Patent: Feb. 21, 2017

(54) ROLLED STEEL BAR FOR HOT FORGING

(71) Applicant: NIPPON STEEL & SUMITOMO METAL CORPORATION, Tokyo (JP)

(72) Inventors: Masashi Higashida, Tokyo (JP); Hitoshi Matsumoto, Tokyo (JP); Naoki Matsui, Tokyo (JP); Yutaka Neishi, Tokyo (JP); Taizo Makino, Tokyo (JP)

(73) Assignee: NIPPON STEEL & SUMITOMO METAL CORPORATION, TOKYO (JP)

( * ) Notice: Subject to any disclaimer, the term of this patent is extended or adjusted under 35 U.S.C. 154(b) by 0 days.

(21) Appl. No.: 14/358,733

(22) PCT Filed: Nov. 7, 2012

(86) PCT No.: PCT/JP2012/078789
§ 371 (c)(1),
(2) Date: May 16, 2014

(87) PCT Pub. No.: WO2013/077182
PCT Pub. Date: May 30, 2013

(65) Prior Publication Data

US 2014/0322066 A1 Oct. 30, 2014

(30) Foreign Application Priority Data

Nov. 21, 2011 (JP) ..... 2011-253412

(51) Int. Cl.

| | |
|---|---|
| ***C22C 38/02*** | (2006.01) |
| ***C22C 38/50*** | (2006.01) |
| ***C22C 38/46*** | (2006.01) |
| ***C22C 38/44*** | (2006.01) |
| ***C22C 38/42*** | (2006.01) |
| ***C22C 38/28*** | (2006.01) |
| ***C22C 38/22*** | (2006.01) |
| ***C22C 38/20*** | (2006.01) |
| ***C22C 38/06*** | (2006.01) |
| ***C22C 38/04*** | (2006.01) |
| ***C22C 38/00*** | (2006.01) |
| ***C22C 38/24*** | (2006.01) |
| *C21D 9/00* | (2006.01) |

(52) U.S. Cl.

CPC ..... *C22C 38/50* (2013.01); *C22C 38/001* (2013.01); *C22C 38/002* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/28* (2013.01); *C22C 38/42* (2013.01); *C22C 38/44* (2013.01); *C22C 38/46* (2013.01); *C21D 9/0075* (2013.01)

(58) Field of Classification Search

CPC ..... C22C 38/001; C22C 38/02; C22C 38/04; C22C 38/06; C22C 38/08; C22C 38/12; C22C 38/14; C22C 38/1618; C22C 38/20; C22C 38/22; C22C 38/24

See application file for complete search history.

(56) References Cited

U.S. PATENT DOCUMENTS

| | | | | |
|---|---|---|---|---|
| 2010/0139811 | A1* | 6/2010 | Kozawa et al. | 148/218 |
| 2010/0143180 | A1 | 6/2010 | Kubota et al. | |
| 2015/0034049 | A1* | 2/2015 | Matsui et al. | 123/456 |

FOREIGN PATENT DOCUMENTS

| | | | | |
|---|---|---|---|---|
| EP | 1 700 925 | | 9/2006 | |
| JP | 06-287677 | | 10/1994 | |
| JP | 08-092687 | | 4/1996 | |
| JP | 09-143610 | | 6/1997 | |
| JP | 09176785 | A * | 7/1997 | C22C 38/00 |
| JP | 2000-239782 | | 9/2000 | |
| JP | 2004-137542 | | 5/2004 | |
| JP | 2010-07143 | | 1/2010 | |

OTHER PUBLICATIONS

English machine translation and original document of JP 09176785 A of Uno et al. (Jul. 1997).*
Claims of copending U.S. Appl. No. 14/378,686.*

* cited by examiner

*Primary Examiner* — Roy King
*Assistant Examiner* — Jophy S Koshy
(74) *Attorney, Agent, or Firm* — Clark & Brody

(57) ABSTRACT

A rolled steel bar has a composition consisting, by mass percent, of C: 0.27 to 0.37%, Si: 0.30 to 0.75%, Mn: 1.00 to 1.45%, S: 0.008% or more and less than 0.030%, Cr: 0.05 to 0.30%, Al: 0.005 to 0.050%, V: 0.200 to 0.320%, and N: 0.0080 to 0.0200%, the balance being Fe and impurities. The contents of P, Ti and O in the impurities are, by mass percent, P: 0.030% or less, Ti: 0.0040% or less, and O: 0.0020% or less. Y1 expressed by the formula <1> is 1.05 to 1.18.

$$Y1=C+(1/10)Si+(1/5)Mn+(5/22)Cr+1.65V-(5/7)S \quad <1>.$$

C, Si, Mn, Cr, V, and S in the formula represent mass percent of the elements. A hot-forged part having a tensile strength of 900 MPa or higher and a transverse endurance ratio of 0.47 can be obtained by the rolled steel bar.

2 Claims, No Drawings

ROLLED STEEL BAR FOR HOT FORGING

TECHNICAL FIELD

The present invention relates to a rolled steel bar for hot forging. More particularly, the present invention relates to a rolled steel bar for hot forging that can be used suitably as a starting material for high-strength, non-refined, and hot-forged parts of automobiles, industrial machines, and the like.

BACKGROUND ART

In recent years, from the viewpoint of reducing $CO_2$ emissions, the need for improving the fuel economy has increased, and for machine structural parts that are used for automobiles, industrial machines, and the like, it has been desired to increase the strength of the parts for the purpose of decreasing the size of the parts.

Also, from the viewpoint of reducing the production cost, there has mainly been used a hot-forged part (hereinafter, a hot-forged part that is produced without being subjected to heat treatment of quenching and tempering is referred to as a "non-refined hot-forged part"), in which a steel bar produced by hot rolling (hereinafter, an as hot-rolled steel bar that is produced by hot rolling is referred to as a "rolled steel bar") is subjected to a forming process by means of hot forging without subsequently being subjected to heat treatment of quenching and tempering, that is, "refining treatment," so as to give a desired strength to the steel bar.

Many of the hot-forged parts are subjected to the forming process by mainly being rolled-down in the axial direction of the rolled steel bar, which is a starting material.

However, some of the hot-forged parts are subjected to the forming process by mainly being rolled-down in the direction perpendicular to the axis of rolled steel bar, that is, in the direction perpendicular to the rolling direction scarcely by being rolled-down in the axial direction of the rolled steel bar. For the hot-forged parts subjected to the forming process by being rolled-down in such a direction, the state of distribution of inclusions and/or precipitates formed in the hot rolling (that is, the state of distribution in the rolled steel bar of inclusions and/or precipitates elongated in the axial direction) remains even after the hot forging. Therefore, there is a tendency for the fatigue strength against the stress in the direction perpendicular to the axis of hot-forged part to decrease (hereinafter, the fatigue strength against the stress in the direction perpendicular to the axis of hot-forged part is referred to as the "transverse fatigue strength").

As the tensile strength of hot-forged part is increased, the transverse fatigue strength can also be increased. However, the increase in tensile strength of the non-refined hot-forged part produced without being subjected to refining treatment leads to a decrease in tool service life in the cutting process carried out after hot forging. For this reason, there arise problems of increasing cutting costs and an increase in cutting time.

Therefore, it is not necessarily desirable that the transverse fatigue strength of hot-forged part be improved by increasing the tensile strength.

In such a situation, Patent Document 1 (JP8-92687A) and Patent Document 2 (JP6-287677A) disclose "High strength and high toughness non-refined steel for hot forging and its production method" and "High strength non-refined steel for hot forging", respectively, as described below.

That is, Patent Document 1 (JP8-92687A) discloses a "high strength and high toughness non-refined steel for hot forging" configured such that in a steel containing, by mass percent, Si: 2% or less (excluding 0%), S: 0.10% or less (excluding 0%), N: 0.02% or less (excluding 0%), O: 0.010% or less (excluding 0%), and unavoidable impurities, the steel further contains, by mass percent, C: 0.10 to 0.6%, Mn: 0.3 to 2.5%, Cr: 0.05 to 2.5%, V: 0.03 to 0.5%, Al: 0.060% or less (excluding 0%), and Ti: 0.005 to 0.03%, and still further contains, by mass percent, as necessary one or more kinds selected from a group of Pb: 0.3% or less (excluding 0%), Ca: 0.01% or less (excluding 0%), Te: 0.3% or less (excluding 0%), Bi: 0.3% or less (excluding 0%), Zr: 0.1% or less (excluding 0%), Hf: 0.1% or less (excluding 0%), Y: 0.1% or less (excluding 0%), rare earth metals: 0.1% or less (excluding 0%), and Mg: 0.1% or less (excluding 0%), the balance being Fe and unavoidable impurities, wherein $1\times10^2$ to $1\times10^6/mm^2$ of inclusions each having an average crystal grain size of 0.1 to 5 μm are contained, and the inclusions are Ti oxides/nitrides, MnS, and composite compounds consisting mainly of the Ti oxides/nitrides and MnS; and a production method therefor.

Patent Document 2 (JP6-287677A) discloses a high strength non-refined steel for hot forging containing, by mass percent, C: 0.25 to 0.50%, Si: 0.40 to 2.00%, Mn: 0.50 to 2.50%, Cr: 0.10 to 1.00%, S: 0.03 to 0.10%, V: 0.05 to 0.30%, and N: 0.0050 to 0.0200%, further containing one or two kinds of Al: 0.005 to 0.050% and Ti: 0.002 to 0.050%, and still further containing Ca: 0.0004 to 0.0050% as necessary, the balance being Fe and unavoidable impurities, wherein the carbon equivalent Ceq. (%) expressed by the formula of $$Ceq.\ (\%)=\%\ C+(\%\ Si)/20+(\%\ Mn)/5+(\%\ Cr)/9+1.54(\%\ V)$$

is 0.83 to 1.23%, and the bainite transformation index Bt expressed by the formula of $$Bt=31.2-100(\%\ C)-6.7(\%\ Si)+9.0(\%\ Mn)+4.9(\%\ Cr)-81(\%\ V)$$

is 0 or less.

LIST OF PRIOR ART DOCUMENT(S)

Patent Document 1: JP8-92687A
Patent Document 2: JP6-287677A

DISCLOSURE OF THE INVENTION

Problems to be Solved by the Invention

According to the technique disclosed in Patent Document 1 (JP8-92687A), a non-refined hot-forged part can be provided with a tensile strength of 90 kgf/mm$^2$ (882.6 MPa) or higher. However, in the case of a steel containing 0.005% or more of Ti as an essential element as in the technique proposed in Patent Document 1 (JP8-92687A), if $1\times10^2$ to $1\times10^6/mm^2$ of inclusions each having an average crystal grain size of 0.1 to 5 μm that are Ti oxides/nitrides, MnS, and composite compounds consisting mainly of the Ti oxides/nitrides and MnS are merely contained, the transverse fatigue strength is decreased by the Ti nitrides arranged in the axial direction of the hot-forged part in the case where a rolled steel bar is used by being rolled-down in the direction perpendicular to the axis thereof and by being formed by means of hot forging.

According to the technique disclosed in Patent Document 2 (JP6-287677A), a non-refined hot-forged part can be provided with a tensile strength of 900 MPa or higher. Moreover, the non-refined hot-forged part is excellent in machinability because the part consists of a mixed structure of ferrite and pearlite (hereinafter, referred to as "ferrite/pearlite") in which the formation of bainite is avoided. However, the steel specifically disclosed in Patent Document 2 (JP6-287677A) contains at least 0.033% of S. In the case where a large amount of S is contained in a steel, there is a possibility that the transverse fatigue strength may be decreased by coarse MnS arranged in the axial direction of the hot-forged part in the case where a rolled steel bar is used by being rolled-down in the direction perpendicular to the axis thereof and by being formed by means of hot forging.

The present invention has been made in view of the above-described present situation, and accordingly an objective thereof is to provide a rolled steel bar for hot forging from which a high-strength, non-refined, and hot-forged part having a tensile strength of 900 MPa or higher and a transverse endurance ratio (fatigue strength/tensile strength) of 0.47 or higher can be obtained.

The transverse endurance ratio is a value obtained by dividing the fatigue strength against the stress in the direction perpendicular to the axis of hot-forged part by the tensile strength in the direction perpendicular to the axis of hot-forged part.

Means for Solving the Problems

The present inventors conducted various studies to solve the above-described problems. As a result, the findings of the following items (a) to (f) were obtained.

(a) For a non-refined hot-forged part, in order to obtain a high transverse endurance ratio, the internal structure (that is, a structure excluding a near-surface portion where a decarburized layer may be formed at the heating stage at the time of hot forging) must be made ferrite/pearlite. On the other hand, in the case where either one or both of bainite and martensite are intermixed in the internal structure, a high transverse endurance ratio cannot be obtained.

(b) In order to avoid the formation of bainite after hot forging and to assure a tensile strength of 900 MPa or higher in the non-refined hot-forged part, the contents of elements for improving the hardenability must be controlled precisely.

(c) For a hot-forged part that is formed by rolling-down a rolled steel bar in the direction perpendicular to the axis of the rolled steel bar, in order to obtain a high transverse fatigue strength, it is effective to contain a precipitation strengthening element. However, it is undesirable to add Ti liable to form coarse nitrides at the solidification time.

(d) On the other hand, unlike Ti, V does not form coarse nitrides at the solidification time. Therefore, the N content can also be increased, whereby a high transverse fatigue strength can be provided by precipitating the carbides, nitrides, or carbo-nitrides of V in the cooling process at the time of hot forging.

(e) By containing a minute amount of S, MnS that has been thought to exert an adverse influence on the transverse fatigue strength can be dispersed finely in the steel bar without being coarsened. Therefore, the formation nucleus of ferrite is increased even within the austenite grains after hot forging, so that the formation of bainite can be restrained.

(f) As a result, a hot-forged part having a tensile strength of 900 MPa or higher and a transverse endurance ratio of 0.47 or higher after hot forging can be obtained.

The present invention has been completed on the basis of the above-described findings, and the gist thereof is rolled steel bars for hot forging described below.

(1) A rolled steel bar for hot forging having a chemical composition consisting, by mass percent, of C: 0.27 to 0.37%, Si: 0.30 to 0.75%, Mn: 1.00 to 1.45%, S: 0.008% or more and less than 0.030%, Cr: 0.05 to 0.30%, Al: 0.005 to 0.050%, V: 0.200 to 0.320%, and N: 0.0080 to 0.0200%, the balance being Fe and impurities, wherein the contents of P, Ti and O in the impurities are, by mass percent, P: 0.030% or less, Ti: 0.0040% or less, and O: 0.0020% or less; and Y1 expressed by the following formula <1> is 1.05 to 1.18.

$$Y1=C+(1/10)Si+(1/5)Mn+(5/22)Cr+1.65V-(5/7)S \quad <1>$$

where, C, Si, Mn, Cr, V, and S in the above formula <1> represent, respectively, the content by mass percent of each of the elements.

(2) A rolled steel bar for hot forging having a chemical composition consisting, by mass percent, of C: 0.27 to 0.37%, Si: 0.30 to 0.75%, Mn: 1.00 to 1.45%, S: 0.008% or more and less than 0.030%, Cr: 0.05 to 0.30%, Al: 0.005 to 0.050%, V: 0.200 to 0.320%, and N: 0.0080 to 0.0200%, and one or more elements selected from Cu: 0.30% or less, Ni: 0.30% or less, and Mo: 0.10% or less, the balance being Fe and impurities, wherein the contents of P, Ti and O in the impurities are, by mass percent, P: 0.030% or less, Ti: 0.0040% or less, and O: 0.0020% or less; and Y2 expressed by the following formula <2> is 1.05 to 1.18.

$$Y2=C+(1/10)Si+(1/5)Mn+(5/22)Cr+1.65V-(5/7)S+(1/5)Cu+(1/5)Ni+(1/4)Mo \quad <2>$$

where, C, Si, Mn, Cr, V, S, Cu, Ni, and Mo in the above formula <2> represent, respectively, the content by mass percent of each of the elements.

The term "impurities" indicate those impurities that are mixed from raw materials such as ore and scrap or production environments when ferrous materials are produced on an industrial scale.

Advantageous Effects(s) of the Invention

By using the rolled steel bar for hot forging of the present invention as a starting material, a high-strength, non-refined, and hot-forged part having a tensile strength of 900 MPa or higher and a transverse endurance ratio of 0.47 or higher can be obtained.

MODE FOR CARRYING OUT THE INVENTION

In the following, the requirements of the present invention are explained in detail. The symbol "%" for the content of each element in the explanation below means "% by mass".

C: 0.27 to 0.37%

C (carbon) is an element for strengthening a steel, and therefore 0.27% or more of C must be contained. On the other hand, if the C content exceeds 0.37%, although the tensile strength after hot forging increases, the transverse endurance ratio decreases in some cases. Therefore, the C content is set to 0.27 to 0.37%. The C content is preferably 0.29% or more and preferably 0.35% or less.

Si: 0.30 to 0.75%

Si (silicon) is a deoxidizing element, and also an element necessary for strengthening ferrite by means of solid-solution strengthening and for enhancing the tensile strength after hot forging. In order to achieve these effects, 0.30% or more of Si must be contained. On the other hand, if the Si content exceeds 0.75%, not only these effects are saturated, but also the surface decarburization of rolled steel bar becomes remarkable. Therefore, the Si content is set to 0.30 to 0.75%. The Si content is preferably 0.35% or more and preferably 0.70% or less.

Mn: 1.00 to 1.45%

Mn (manganese) is an element for strengthening ferrite and pearlite by means of solid-solution strengthening and for enhancing the tensile strength after hot forging, and therefore 1.00% or more of Mn must be contained. On the other hand, if the Mn content exceeds 1.45%, not only these effects are saturated, but also the hardenability is enhanced, and bainite is formed after hot forging, so that the transverse fatigue strength is decreased in some cases. Therefore, the Mn content is set to 1.00 to 1.45%. The Mn content is preferably 1.10% or more and preferably 1.40% or less.

S: 0.008% or More and Less than 0.030%

S (sulfur) is an important element in the present invention. S combines with Mn to form MnS, and increases the formation nucleus of ferrite within the austenite grains after hot forging as well, so that the formation of bainite can be restrained. Further, the machinability is also improved by MnS. Therefore, 0.008% or more of S must be contained. On the other hand, if the S content becomes 0.030% or more, MnS takes an elongated coarse form, so that the transverse fatigue strength is decreased, and the transverse endurance ratio is decreased. Therefore, the S content must be controlled precisely, and the S content is set to 0.008% or more and less than 0.030%. The S content is preferably 0.010% or more and preferably 0.027% or less.

Cr: 0.05 to 0.30%

Like Mn, Cr (chromium) is an element for strengthening ferrite and pearlite by means of solid-solution strengthening and for enhancing the tensile strength after hot forging, and therefore 0.05% or more of Cr must be contained. On the other hand, if the Cr content exceeds 0.30%, not only these effects are saturated, but also the hardenability is enhanced, and bainite is formed after hot forging, so that the transverse fatigue strength is decreased in some cases. Therefore, the Cr content is set to 0.05 to 0.30%. The Cr content is preferably 0.08% or more and preferably 0.20% or less. The Cr content is further preferably less than 0.20%.

Al: 0.005 to 0.050%

Al (aluminum) not only has a deoxidizing function but also has functions of combining with N to form AlN, restraining the growth of austenite grains at the time of hot forging owing to the pinning effect thereof, and restraining the formation of bainite. Therefore, 0.005% or more of Al must be contained. On the other hand, if the Al content exceeds 0.050%, the above-described effects are saturated. Therefore, the Al content is set to 0.005 to 0.050%. The Al content is preferably 0.010% or more.

V: 0.200 to 0.320%

V (vanadium) combines with C and N to form carbides and nitrides or carbo-nitrides, and has a function of effectively increasing the transverse endurance ratio of hot-forged part. Therefore, 0.200% or more of V is contained. On the other hand, if the V content exceeds 0.320%, not only the above-described effect is saturated, but also the cost rises. Therefore, the V content is set to 0.200 to 0.320%. The V content is preferably 0.220% or more and preferably 0.300% or less.

N: 0.0080 to 0.0200%

N (nitrogen) is an important element in the present invention. N has functions of combining with V to form nitrides or carbo-nitrides and effectively increasing the transverse endurance ratio of hot-forged part, and also combining with Al to form AlN and restraining the growth of austenite grains at the time of hot forging owing to the pinning effect thereof and restraining the formation of bainite. Therefore, 0.0080% or more of N must be contained. However, if the N content increases and especially exceeds 0.0200%, a pinhole is formed in a steel in some cases. Therefore, the N content is set to 0.0080 to 0.0200%. The N content is preferably 0.0090% or more and preferably 0.0150% or less.

The rolled steel bar for hot forging of the present invention is a steel having a chemical composition consisting of the above-described elements ranging from C to N with the balance being Fe and impurities, in which the contents of P, Ti and O in the impurities are P: 0.030% or less, Ti: 0.0040% or less, and O: 0.0020% or less: and Y1 expressed by the formula <1> is 1.05 to 1.18.

As described already, the term "impurities" indicate those impurities that are mixed from raw materials such as ore and scrap or production environments when ferrous materials are produced on an industrial scale.

Hereunder, there is explained the reasons for restricting the contents of P, Ti and O in the impurities to the above-described ranges, respectively, in the present invention.

P: 0.030% or Less

P (phosphorus) is an element contained as an impurity in a steel. In particular, if the P content exceeds 0.030%, the segregation becomes remarkable, and the fatigue strength is decreased in some cases. Therefore, the P content in the impurities is set to 0.030% or less. The P content in the impurities is preferably 0.025% or less. It is desirable that the P content contained as an impurity be as low as possible as far as not raising the cost in the steel making process.

Ti: 0.0040% or Less

In the present invention, Ti (titanium) is an element the content of which must be restricted. However, Ti is mixed unavoidably from ore, scrap, and the like. In particular, if the compounding ratio of scrap is increased by attaching importance to the holding-down of raw material cost, the mixing amount of Ti increases in spite of an impurity. If the mixing amount of Ti increases, and coarse Ti nitrides are formed, and the Ti nitrides are arranged undesirably in the axial direction of the hot-forged part. In particular, if the Ti content exceeds 0.0040%, the transverse fatigue strength is decreased, and the transverse endurance ratio of 0.47 or higher cannot be obtained. Therefore, the Ti content in the impurities is set to 0.0040% or less. The Ti content in the impurities is preferably 0.0035% or less, further preferably less than 0.0030%.

O: 0.0020% or Less

O (oxygen) is an impurity element that mainly exists as an oxide-based inclusion in a steel, and decreases the transverse fatigue strength. If the O content increases and exceeds 0.0020%, the generation frequency of coarse oxides increases, so that the transverse fatigue strength is decreased, and the transverse endurance ratio is decreased. Therefore, the O content in the impurities is set to 0.0020% or less. The O content in the impurities is preferably 0.0015% or less.

The reason for restricting Y1 expressed by formula <1> is described later together with the reason for restricting Y2 expressed by formula <2>.

The rolled steel bar for hot forging of the present invention may contain one or more kinds of elements selected from a group of Cu, Ni and Mo as necessary in lieu of a part of the Fe. In this case, Y2 expressed by the formula <2> is 1.05 to 1.18.

Hereunder, the operational advantages and the reasons for restricting the contents of Cu, Ni and Mo, which are optional elements, are explained.

Cu: 0.30% or Less

Cu (copper) is an element for strengthening ferrite and pearlite by means of solid-solution strengthening. For this reason, Cu may be contained. However, if the Cu content exceeds 0.30%, not only this effect is saturated, but also the hardenability is enhanced, and bainite is formed after hot forging, so that the transverse fatigue strength is decreased in some cases. Therefore, the upper limit was placed on the content of Cu, if contained, and the content of Cu, if contained, is set to 0.30% or less. The content of Cu, if contained, is preferably 0.20% or less.

On the other hand, in order to stably achieve the above-described effect of Cu, the content of Cu is preferably 0.03% or more, further preferably 0.05% or more.

Ni: 0.30% or Less

Ni (nickel) is an element for strengthening ferrite and pearlite by means of solid-solution strengthening. For this reason, Ni may be contained. However, if the Ni content exceeds 0.30%, not only this effect is saturated, but also the hardenability is enhanced and bainite is formed after hot forging, so that the transverse fatigue strength is decreased in some cases. Therefore, the upper limit was placed on the content of Ni, if contained, and the content of Ni, if contained, is set to 0.30% or less. The content of Ni, if contained, is preferably 0.20% or less.

On the other hand, in order to stably achieve the above-described effect of Ni, the content of Ni is preferably 0.03% or more, further preferably 0.05% or more.

Mo: 0.10% or Less

Mo (molybdenum) is an element for strengthening ferrite and pearlite by means of solid-solution strengthening. For this reason, Mo may be contained. However, if the Mo content exceeds 0.10%, bainite is formed after hot forging, so that the transverse fatigue strength is decreased in some cases. Therefore, the upper limit was placed on the content of Mo, if contained, and the content of Mo, if contained, is set to 0.10% or less. The content of Mo, if contained, is preferably 0.08% or less.

On the other hand, in order to stably achieve the above-described effect of Mo, the content of Mo, if contained, is preferably 0.03% or more.

Only any one kind of Cu, Ni and Mo may be contained, or two or more kinds of these elements may be contained compositely. The total content of Cu, Ni and Mo is preferably 0.30% or less.

Y1 or Y2: 1.05 to 1.18

In order to provide the non-refined hot-forged part with a tensile strength of 900 MPa or higher, the rolled steel bar for hot forging that is a starting material for the non-refined hot-forged part must be configured so that, in the case where Cu, Ni and Mo are not contained, Y1[=C+(1/10)Si+(1/5)Mn+(5/22)Cr+1.65V−(517)S] expressed by formula <1> is 1.05 to 1.18, or in the case where one or more kinds of Cu, Ni and Mo are contained, Y2[=C+(1/10)Si+(1/5)Mn+(5/22)Cr+1.65V−(5/7)S+(1/5)Cu+(1/5)Ni+(1/4)Mo] expressed by formula <2> is 1.05 to 1.18.

If Y1 or Y2 becomes more than 1.18, the hardness after hot forging is increased, so that the machinability is decreased in some cases. Further, the hardenability is enhanced, and bainite is formed after hot forging, so that the transverse endurance ratio may be decreased. On the other hand, if Y1 or Y2 becomes less than 1.05, the non-refined hot-forged part the starting material of which is the rolled steel bar for hot forging cannot be provided with a tensile strength of 900 MPa or higher.

Y1 or Y2 is preferably 1.08 or more and preferably 1.16 or less.

The rolled steel bar for hot forging of the present invention can be produced by the procedure described below. A cast piece having the chemical composition defined in the present invention is heated, for example, at a temperature of 1200 to 1300° C. for 120 to 180 minutes, and thereafter is bloomed to prepare a slab measuring 180 mm×180 mm. Subsequently, the slab is heated at a temperature of 1150 to 1250° C. for 90 to 150 minutes, and is rolled in the temperature range of 1100 to 1000° C. into a steel bar having a predetermined size, for example, a diameter of 40 mm.

Then, the rolled steel bar for hot forging of the present invention having the predetermined size, for example, a diameter of 40 mm is cut to a length of 100 mm. The cut steel bar is heated to a temperature of 1200 to 1250° C. with a high-frequency heating device, thereafter being press-forged in the direction perpendicular to the axis of the rolled steel bar in the temperature range of 1150 to 1100° C. by using a hot forging machine to a thickness of 18 mm, and is cooled in the temperature range of 800 to 550° C. at a cooling rate of 30 to 50° C./min. Thereby, a non-refined hot-forged part having a tensile strength of 900 MPa or higher and a transverse endurance ratio of 0.47 or higher can be obtained easily.

The "heating temperature" of the cast piece and the slab represents the temperature in the furnace at the time when the cast piece and the slab are heated.

The steel bar rolling temperature represents the surface temperature of the workpiece.

The "heating temperature" of the steel bar at the time when the high-frequency heating device is used represents the surface temperature of steel bar. The press-forging temperature at the time when the hot forging machine is used and the temperature at which the steel bar is cooled at a cooling rate of 30 to 50° C./min after forging also represent the surface temperature of the workpiece.

The "cooling rate" in the temperature range of 800 to 550° C. after forging is a value obtained by dividing the temperature difference of 250° C. by the time required for decreasing the surface temperature of workpiece from 800° C. to 550° C.

The following examples illustrate the present invention more specifically. The present invention is not limited to these examples.

EXAMPLE(S)

Cast pieces each having a cross section of 300 mm×400 mm consisting of steels A to U having chemical compositions given in Table 1 were heated at 1250° C. for 120 minutes, and thereafter were bloomed to prepare slabs each measuring 180 mm×180 mm. Subsequently, the slabs were heated at 1200° C. for 90 minutes, and were hot-rolled in the temperature range of 1100 to 1000° C. to produce steel bars each having a diameter of 40 mm.

The steels A to J given in Table 1 are steels the chemical compositions of which are within the range defined in the present invention. On the other hand, the steels K to U are steels the chemical compositions of which are out of the range defined in the present invention.

TABLE 1

| Steel | Chemical composition (mass %) Balance: Fe and impurities | | | | | | | | | | | | | | |
|---|---|---|---|---|---|---|---|---|---|---|---|---|---|---|---|
| | C | Si | Mn | P | S | Cr | Al | V | Ti | N | O | Cu | Ni | Mo | Y1 or Y2 |
| A | 0.33 | 0.52 | 1.38 | 0.010 | 0.020 | 0.13 | 0.032 | 0.238 | 0.0008 | 0.0123 | 0.0013 | — | — | — | 1.07 |
| B | 0.34 | 0.58 | 1.29 | 0.014 | 0.013 | 0.15 | 0.033 | 0.274 | 0.0030 | 0.0113 | 0.0009 | — | — | — | 1.13 |
| C | 0.29 | 0.41 | 1.39 | 0.008 | 0.026 | 0.10 | 0.012 | 0.298 | 0.0010 | 0.0102 | 0.0015 | — | — | — | 1.10 |
| D | 0.35 | 0.63 | 1.14 | 0.009 | 0.019 | 0.13 | 0.043 | 0.285 | 0.0015 | 0.0130 | 0.0013 | — | — | — | 1.13 |
| E | 0.30 | 0.38 | 1.32 | 0.012 | 0.021 | 0.14 | 0.021 | 0.290 | 0.0035 | 0.0154 | 0.0011 | — | — | — | 1.10 |
| F | 0.32 | 0.63 | 1.40 | 0.021 | 0.018 | 0.13 | 0.035 | 0.289 | 0.0018 | 0.0098 | 0.0010 | — | — | — | 1.16 |
| G | 0.34 | 0.43 | 1.31 | 0.023 | 0.023 | 0.09 | 0.010 | 0.243 | 0.0011 | 0.0131 | 0.0012 | — | 0.08 | — | 1.07 |
| H | 0.32 | 0.53 | 1.13 | 0.011 | 0.017 | 0.10 | 0.025 | 0.287 | 0.0013 | 0.0113 | 0.0011 | 0.05 | 0.06 | 0.05 | 1.12 |
| I | 0.33 | 0.65 | 1.18 | 0.015 | 0.010 | 0.10 | 0.043 | 0.252 | 0.0022 | 0.0122 | 0.0012 | 0.07 | — | 0.07 | 1.09 |
| J | 0.32 | 0.55 | 1.26 | 0.013 | 0.014 | 0.16 | 0.039 | 0.271 | 0.0021 | 0.0121 | 0.0008 | — | — | 0.04 | 1.11 |
| K | 0.37 | 0.74 | 1.30 | 0.021 | 0.009 | 0.25 | 0.023 | *0.177 | 0.0035 | 0.0125 | 0.0011 | — | — | — | 1.05 |
| L | 0.36 | 0.63 | 1.39 | 0.014 | 0.013 | 0.27 | 0.030 | 0.293 | 0.0009 | 0.0132 | 0.0010 | — | — | — | *1.24 |
| M | 0.33 | 0.52 | 1.33 | 0.012 | 0.023 | 0.09 | 0.018 | 0.245 | 0.0018 | 0.0114 | 0.0013 | — | *0.35 | — | 1.12 |
| N | 0.32 | 0.48 | 1.31 | 0.017 | 0.018 | 0.10 | 0.016 | 0.283 | *0.0098 | 0.0143 | 0.0009 | — | — | — | 1.11 |
| O | 0.35 | 0.63 | *1.53 | 0.015 | 0.016 | 0.16 | 0.026 | 0.231 | 0.0021 | 0.0119 | 0.0006 | — | — | — | 1.13 |
| P | 0.35 | 0.63 | 1.38 | 0.010 | 0.019 | 0.19 | 0.017 | 0.283 | 0.0032 | 0.0132 | 0.0010 | 0.12 | 0.04 | 0.05 | *1.23 |
| Q | 0.30 | 0.43 | 1.12 | 0.013 | 0.024 | 0.12 | 0.019 | 0.235 | 0.0018 | 0.0158 | 0.0012 | — | — | — | *0.96 |
| R | 0.31 | 0.53 | 1.30 | 0.022 | *0.043 | 0.15 | 0.042 | 0.272 | 0.0013 | 0.0095 | 0.0014 | — | — | — | 1.08 |
| S | 0.29 | 0.58 | 1.13 | 0.009 | 0.014 | 0.10 | 0.035 | 0.239 | 0.0014 | 0.0121 | 0.0009 | 0.04 | — | 0.02 | *0.99 |
| T | 0.34 | 0.62 | 1.22 | 0.012 | 0.016 | 0.11 | 0.024 | 0.253 | 0.0031 | 0.0109 | *0.0031 | — | — | — | 1.08 |
| U | *0.45 | 0.36 | 1.45 | 0.018 | 0.021 | 0.15 | 0.037 | 0.205 | 0.0021 | 0.0138 | 0.0010 | — | — | — | 1.13 |

(In the case where Cu, Ni and Mo are not contained) Y1 = C + (1/10)Si + (1/5)Mn + (5/22)Cr + 1.65V − (5/7)S (In the case where one or more kinds of Cu, Ni and Mo are contained) Y2 = C + (1/10)Si + (1/5)Mn + (5/22)Cr + 1.65V − (5/7)S + (1/5)Cu + (1/5)Ni + (1/4)Mo Mark * indicates that the numerical value deviates from the chemical component defined in the present invention.

Next, forged products each having a thickness of 18 mm was produced by hot forging by using the steel bars each having a diameter of 40 mm as starting materials.

Specifically, first, each of the steel bars each having a diameter of 40 mm was cut to a length of 110 mm.

Next, the steel bar having a diameter of 40 mm and a length of 110 mm was heated to 1250° C. with a high-frequency heating device, thereafter being subjected to hot forging in which the steel bar was rolled down in the direction perpendicular to the axis of steel bar by a press at a temperature of 1150 to 1100° C. to finish a forged product having a thickness of 18 mm, and was cooled to room temperature by allowing the forged product to cool in the atmosphere. The cooling rate in the temperature range of 800 to 550° C. was 30° C./min.

For the forged product, the micro-structure, tensile property, and fatigue property were examined by the methods of the following items <1> to <3>, respectively.

<1> Examination of Micro-Structure of Forged Product

A specimen having a transverse section of 10 mm×10 mm was cut out from a ½ position in the width direction and a ½ position in the thickness direction of the forged product having a thickness of 18 mm. Next, the specimen was embedded in a resin so that the transverse section was a surface to be examined, the transverse section being mirror polished, and thereafter the mirror polished surface was etched with 3% alcohol nitride (nital) to cause the micro-structure to appear. Subsequently, the image of micro-structure was captured in five visual fields by using an optical microscope having a magnification of ×500 to identify the "phase".

<2> Examination of Tensile Property of Forged Product

A No. 14A test specimen (diameter of parallel part: 5 mm) specified in JIS Z2201 (1998) of JIS Handbook [1] Ferrous Materials and Metallurgy I issued by Japanese Standards Association on Jan. 21, 2011, was sampled from a ½ position in the thickness direction of the forged product having a thickness of 18 mm so that the longitudinal direction of test specimen was the width direction of forged product, that is, the direction perpendicular to the axis of forged product, and that the center of the parallel part of test specimen lies at the ½ position in the width direction of forged product. A tension test was conducted at room temperature with the gage length being 25 mm to determine the tensile strength. The target of the tensile strength of forged product was set so as to be 900 MPa or higher.

<3> Examination of fatigue property of forged product

Also, both the ends of the width of forged product having a thickness of 18 mm were milled to remove scale and to finish both the ends to flat planes. Next, both of the milled ends of forged product and a commercially available S10C steel material specified in JIS G4051 (2009) were welded to each other by electron beam welding to prepare a plate material having a width of 130 mm. Subsequently, an Ono type rotating bending fatigue test specimen having a diameter of parallel part of 8 mm and a length of 106 mm was sampled from a ½ position in the thickness direction of the plate material so that the longitudinal direction of test specimen is the width direction of plate material, that is, the direction perpendicular to the axis of forged product, and that the center of the parallel part of test specimen lies at the ½ position in the width direction of plate material.

Then, a rotating bending fatigue test was conducted at room temperature in the atmosphere under the condition that the stress ratio is −1 with the number of tests being eight. The lowest value of stress amplitude endured with the number of repetitions being $1.0\times10^7$ or larger was set so as to be a fatigue strength. Further, a transverse endurance ratio was determined by dividing the fatigue strength by the tensile strength. The target of the transverse endurance ratio of forged product was set so as to be 0.47 or higher.

Table 2 summarizes the results of the tests. The mark "○" in the "evaluation" column of Table 2 indicates that both of the tensile strength and the transverse endurance ratio of forged product met the targets, and the mark "×" indicates that at least one property did not meet the target.

TABLE 2

| Test No. | Steel | Forged product: Micro-structure | Tensile strength (MPa) | Fatigue strength (MPa) | Trans-verse endur-ance ratio | Eval-ua-tion | Remarks |
|---|---|---|---|---|---|---|---|
| 1 | A | F + P | 943 | 450 | 0.48 | ○ | Example embodi-ment of present invention |
| 2 | B | F + P | 1020 | 485 | 0.48 | ○ | |
| 3 | C | F + P | 973 | 480 | 0.49 | ○ | |
| 4 | D | F + P | 1012 | 490 | 0.48 | ○ | |
| 5 | E | F + P | 968 | 470 | 0.49 | ○ | |
| 6 | F | F + P | 1039 | 495 | 0.48 | ○ | |
| 7 | G | F + P | 953 | 455 | 0.48 | ○ | |
| 8 | H | F + P | 970 | 465 | 0.48 | ○ | |
| 9 | I | F + P | 953 | 460 | 0.48 | ○ | |
| 10 | J | F + P | 948 | 445 | 0.47 | ○ | |
| 11 | *K | F + P | 921 | 405 | $ 0.44 | x | Compar-ative example |
| 12 | *L | F + P + B | 1083 | 440 | $ 0.41 | x | |
| 13 | *M | F + P + B | 1023 | 410 | $ 0.40 | x | |
| 14 | *N | F + P | 1001 | 440 | $ 0.44 | x | |
| 15 | *O | F + P + B | 1034 | 420 | $ 0.41 | x | |
| 16 | *P | F + P + B | 1092 | 445 | $ 0.41 | x | |
| 17 | *Q | F + P | $ 868 | 410 | 0.47 | x | |
| 18 | *R | F + P | 964 | 405 | $ 0.42 | x | |
| 19 | *S | F + P | $ 874 | 420 | 0.48 | x | |
| 20 | *T | F + P | 965 | 410 | $ 0.42 | x | |
| 21 | *U | F + P | 1015 | 460 | $ 0.45 | x | |

"F + P" in micro-structure column indicates ferrite/pearlite structure, and "F + P + B" indicates mixed structure of ferrite/pearlite and bainite.
Mark * indicates deviation from conditions defined in present invention.
Mark $ indicates that target is not met.

Table 2 reveals that test Nos. 1 to 10, which are the example embodiments of the present invention that meet the conditions defined in the present invention, are evaluated as "○". That is, it is apparent that, for test Nos. 1 to 10, all of the micro-structures of forged products produced by using the steel bars as starting materials are ferrite/pearlite, and the target tensile strength of 900 MPa or higher and the target transverse endurance ratio of 0.47 or higher are attained.

In contrast, for test Nos. 11 to 21, which are comparative examples that do not meet the chemical compositions defined in the present invention, either the tensile strength or the transverse endurance ratio of forged product does not meet the target.

In test No. 11, the V content of the used steel K is 0.177%, being lower than the range defined in the present invention. Therefore, the transverse endurance ratio of forged product is as low as 0.44.

In test No. 12, although the contents of elements of the used steel L meet the conditions defined in the present invention, Y1 is as high as 1.24, deviating from the range defined in the present invention. Therefore, in addition to ferrite and pearlite, bainite is recognized in the micro-structure of forged product, and the transverse endurance ratio is as low as 0.41.

In test No. 13, the Ni content of the used steel M is 0.35%, exceeding the range defined in the present invention. Therefore, in addition to ferrite and pearlite, bainite is recognized in the micro-structure of forged product, and the transverse endurance ratio is as low as 0.40.

In test No. 14, the Ti content of the used steel N is 0.0098%, exceeding the range defined in the present invention. Therefore, the transverse endurance ratio of forged product is as low as 0.44.

In test No. 15, the Mn content of the used steel O is 1.53%, exceeding the range defined in the present invention. Therefore, in addition to ferrite and pearlite, bainite is recognized in the micro-structure of forged product, and the transverse endurance ratio is as low as 0.41.

In test No. 16, although the contents of elements of the used steel P meet the conditions defined in the present invention, Y2 is as high as 1.23, deviating from the range defined in the present invention. Therefore, in addition to ferrite and pearlite, bainite is recognized in the micro-structure of forged product, and the transverse endurance ratio is as low as 0.41.

In test No. 17, although the contents of elements of the used steel Q meet the conditions defined in the present invention, Y1 is as low as 0.96, deviating from the range defined in the present invention. Therefore, the tensile strength of forged product is as low as 868 MPa.

In test No. 18, the S content of the used steel R is 0.043%, exceeding the range defined in the present invention. Therefore, the transverse endurance ratio of forged product is as low as 0.42.

In test No. 19, although the contents of elements of the used steel S meet the conditions defined in the present invention, Y2 is as low as 0.99, deviating from the range defined in the present invention. Therefore, the tensile strength of forged product is as low as 874 MPa.

In test No. 20, the O content of the used steel T is 0.0031%, exceeding the range defined in the present invention. Therefore, the transverse endurance ratio of forged product is as low as 0.42.

In test No. 21, the C content of the used steel U is 0.45%, exceeding the range defined in the present invention. Therefore, the transverse endurance ratio of forged product is as low as 0.45.

INDUSTRIAL APPLICABILITY

By using the rolled steel bar for hot forging of the present invention as a starting material, a high-strength, non-refined, and hot-forged part having a tensile strength of 900 MPa or higher and a transverse endurance ratio of 0.47 or higher can be obtained.

What is claimed is:

1. A rolled steel bar for a hot-forged part having a chemical composition consisting, by mass percent, of C: 0.27 to 0.37%, Si: 0.30 to 0.75%, Mn: 1.00 to 1.45%, S: 0.008% or more and less than 0.030%, Cr: 0.05 to 0.30%, Al: 0.005 to 0.050%, V: 0.200 to 0.320%, and N: 0.0080 to 0.0200%, the balance being Fe and impurities, wherein the hot-forged part having a transverse tensile strength of 900 MPa or higher and a transverse endurance ratio of 0.47 or higher, and wherein, the contents of P, Ti and O in the impurities are, by mass percent, P: 0.030% or less, Ti: 0.0040% or less, and O: 0.0020% or less; and Y1 expressed by the following formula <1> is 1.05 to 1.18, $$Y1=C+(1/10)Si+(1/5)Mn+(5/22)Cr+1.65V-(5/7)S \quad <1>$$

where, C, Si, Mn, Cr, V, and S in the above formula <1> represent, respectively, the content by mass percent of each of the elements.

2. A rolled steel bar for a hot forged part having a chemical composition consisting, by mass percent, of C: 0.27 to 0.37%, Si: 0.30 to 0.75%, Mn: 1.00 to 1.45%, S: 0.008% or more and less than 0.030%, Cr: 0.05 to 0.30%, Al: 0.005 to 0.050%, V: 0.200 to 0.320%, and N: 0.0080 to 0.0200%, and one or more elements selected from the group consisting of Cu: 0.30% or less, Ni: 0.30% or less, and Mo: 0.10% or less, the balance being Fe and impurities, wherein the hot-forged part having a transverse tensile strength of 900 MPa or higher and a transverse endurance ratio of 0.47 or higher, and wherein, the contents of P, Ti and O in the impurities are, by mass percent, P: 0.030% or less, Ti: 0.0040% or less, and O: 0.0020% or less; and Y2 expressed by the following formula <2> is 1.05 to 1.18, $$Y2=C+(1/10)Si+(1/5)Mn+(5/22)Cr+1.65V-(5/7)S+(1/5)Cu+(1/5)Ni+(1/4)Mo \quad <2>$$

where, C, Si, Mn, Cr, V, S, Cu, Ni, and Mo in the above formula <2> represent, respectively, the content by mass percent.

* * * * *